US008151903B2

(12) United States Patent
Crawford et al.

(10) Patent No.: US 8,151,903 B2
(45) Date of Patent: Apr. 10, 2012

(54) ROTARY BLASTHOLE DRILLING RIG FLEXIBLE JAW PIPE POSITIONER

(75) Inventors: Bruce Crawford, Denison, TX (US); Steven M. Precopia, Sherman, TX (US)

(73) Assignee: Caterpillar Global Mining LLC, South Milwaukee, WI (US)

( * ) Notice: Subject to any disclaimer, the term of this patent is extended or adjusted under 35 U.S.C. 154(b) by 293 days.

(21) Appl. No.: 12/429,587

(22) Filed: Apr. 24, 2009

(65) Prior Publication Data

US 2010/0270082 A1 Oct. 28, 2010

(51) Int. Cl.
*E21B 19/00* (2006.01)

(52) U.S. Cl. ..... 175/52; 175/85

(58) Field of Classification Search ..... 166/75.11, 166/77.51, 85.1; 175/52, 85; 294/103.1, 294/104, 86.1
See application file for complete search history.

(56) References Cited

U.S. PATENT DOCUMENTS 2,281,128 A * 4/1942 Wilson ..... 294/91
2,596,828 A * 5/1952 Stone ..... 414/22.51
3,613,906 A * 10/1971 Deyo et al. ..... 414/22.71
4,746,246 A * 5/1988 Cowan et al. ..... 405/191
5,653,297 A * 8/1997 Whisenhunt ..... 175/52
5,931,238 A * 8/1999 Gilmore et al. ..... 175/52
6,047,775 A * 4/2000 Mock ..... 166/377
6,119,558 A * 9/2000 Foley, Jr. ..... 81/90.5
6,138,529 A * 10/2000 Pietras ..... 81/57.33
7,275,777 B1 * 10/2007 Urdiales ..... 294/16

FOREIGN PATENT DOCUMENTS

WO WO2010124194 * 4/2010

OTHER PUBLICATIONS

International Search Report for W02010124194 dated Jan. 7, 2011.*

* cited by examiner

*Primary Examiner* — Kenneth L Thompson

(74) *Attorney, Agent, or Firm* — Foley & Lardner LLP

(57) ABSTRACT

A pipe positioner having an arm including a lower jaw and an upper jaw mounted thereon is provided. The pipe positioner includes at least one of the lower jaw and the upper jaw with at least one shear pin disposed in location to provide protection of the pipe positioner from mechanical overload. A method for retrofit of a pipe positioner and a blasthole drilling rig are disclosed.

15 Claims, 11 Drawing Sheets

ROTARY BLASTHOLE DRILLING RIG FLEXIBLE JAW PIPE POSITIONER

BACKGROUND OF THE INVENTION

1. Field of the Invention

The invention disclosed herein relates to boring and penetrating the earth and, in particular, to a blasthole drilling rig with a magazine for successively moving unconnected oriented shaft sections.

2. Description of the Related Art

Articulated drill pipe positioner mechanisms have been used in the industry of blasthole drilling for some time. Typically such positioners include one or two moveable jaws, which close axially against opposite sides of the drill pipe by the use of a hydraulic force. The combined jaws, when closed, serve to act as a lower anchoring point or bushing, to retain center control of the drill pipe and lessen side loads which would otherwise be transmitted to the rotary head gearbox. The pipe positioner also minimizes pipe bow due to column deflection. Axial and rotational movement of the drill pipe is permitted, as the jaws do not tightly clamp to the pipe. The jaws open and swing out of the way on an articulated arm when drilling operations require the pipe to be changed, and when the rotary head gearbox is at the lower end of its travel within the mast, so as to eliminate interference.

In certain conditions, excessive load may be applied to the drill pipe and pipe positioner by an out-of-sequence operator command, which attempts to move the drill pipe out of the pipe positioner by forcing the pipe to displace in a radial direction. Due to limitations within the operating control system logic, it is not feasible to lock out the possibility of overload without impairing normal drilling operations. This overload may induce mechanical failure of the pipe positioner or its supporting articulated arm, or the structure of the mast. Such damage can be costly to repair, and renders the drilling rig inoperable until repairs can be effected. The purpose of this invention is to provide a means to perform the same intended function as traditional pipe positioner jaws, while acting as a mechanical fuse to prevent damage in the event of an overload condition.

Therefore, what is needed is method and apparatus that provide location control of the drill pipe during operation and secure transport for a lower end of the pipe string, while preventing an occurrence of physical damage in the event that an improper command is issued that results in an application of excessive load.

BRIEF SUMMARY OF THE INVENTION

In one embodiment, the invention includes a pipe positioner having an arm including a lower jaw and an upper jaw mounted thereon, at least one of the lower jaw and the upper jaw including at least one shear pin disposed in location to provide protection of the pipe positioner from mechanical overload.

In another embodiment, the invention provides a method for retrofitting a pipe positioner, that includes: removing at least one of a lower jaw and an upper jaw from an arm of the pipe positioner; and replacing the at least one removed jaw with a corresponding replacement jaw including at least one shear pin disposed in location to provide protection of the pipe positioner from mechanical overload.

In a further embodiment, the invention provides a blasthole drilling rig that includes a mast having a carousel therein, the carousel for providing at least one length of drill pipe to a drilling apparatus; a pipe positioner for clamping the at least one length of drill pipe; wherein the pipe positioner includes an arm coupled to the mast and including a lower jaw and an upper jaw mounted thereon, at least one of the lower jaw and the upper jaw including at least one shear pin disposed in location to provide protection of the pipe positioner from mechanical overload.

BRIEF DESCRIPTION OF THE DRAWINGS

The subject matter which is regarded as the invention is particularly pointed out and distinctly claimed in the claims at the conclusion of the specification. The foregoing and other features and advantages of the invention are apparent from the following detailed description taken in conjunction with the accompanying drawings in which:

DETAILED DESCRIPTION OF THE INVENTION

Disclosed are an improved pipe positioner useful for positioning drill pipe in a blasthole drilling rig, and methods for using the improved pipe positioner. The pipe positioner includes a fail-safe mechanism to limit damage resulting from excessive loading during operation, such as excessive loading which might result from inadvertent issuance of out-of-sequence control commands.

Figure 1:
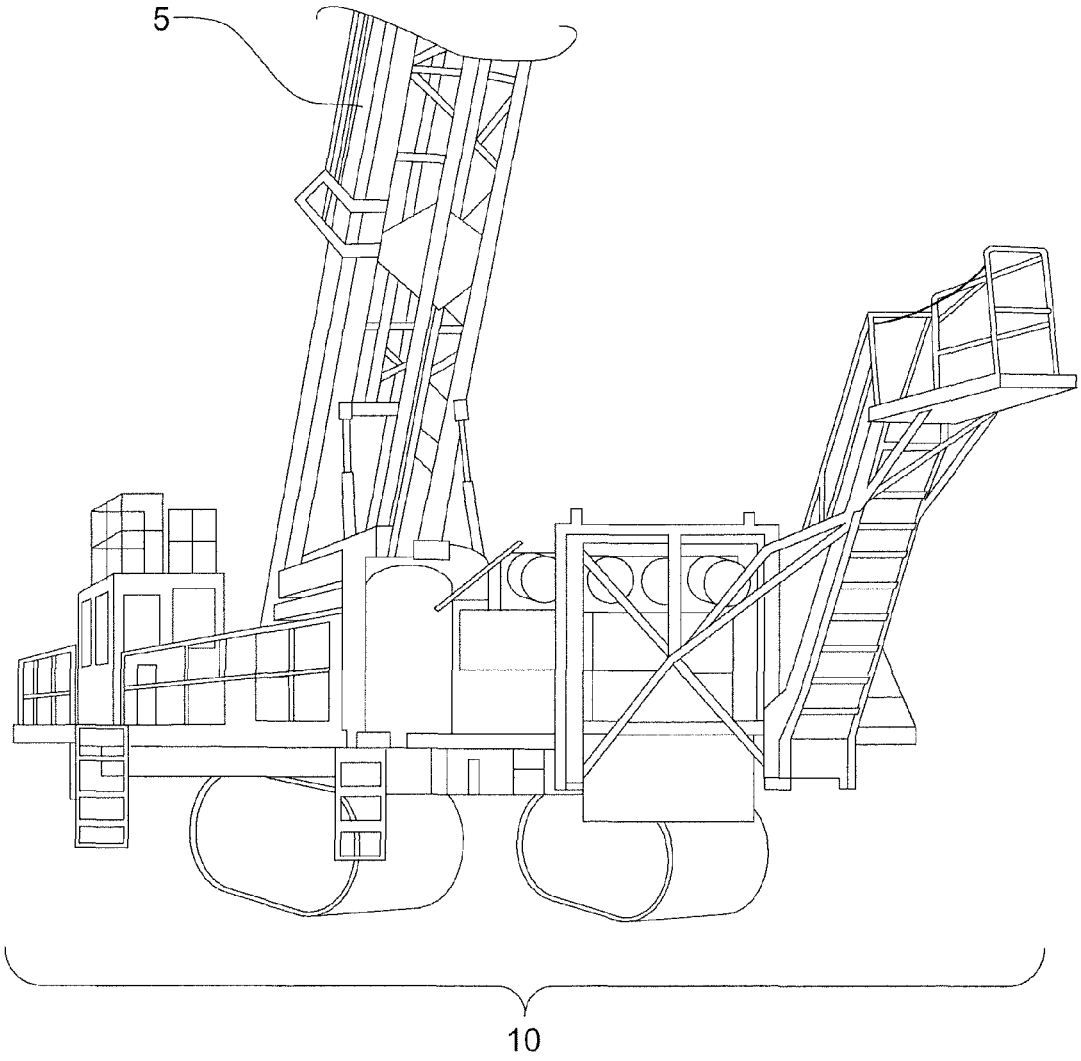
FIG. 1 depicts an exemplary blasthole drilling rig set up for drilling.
Figure 2:
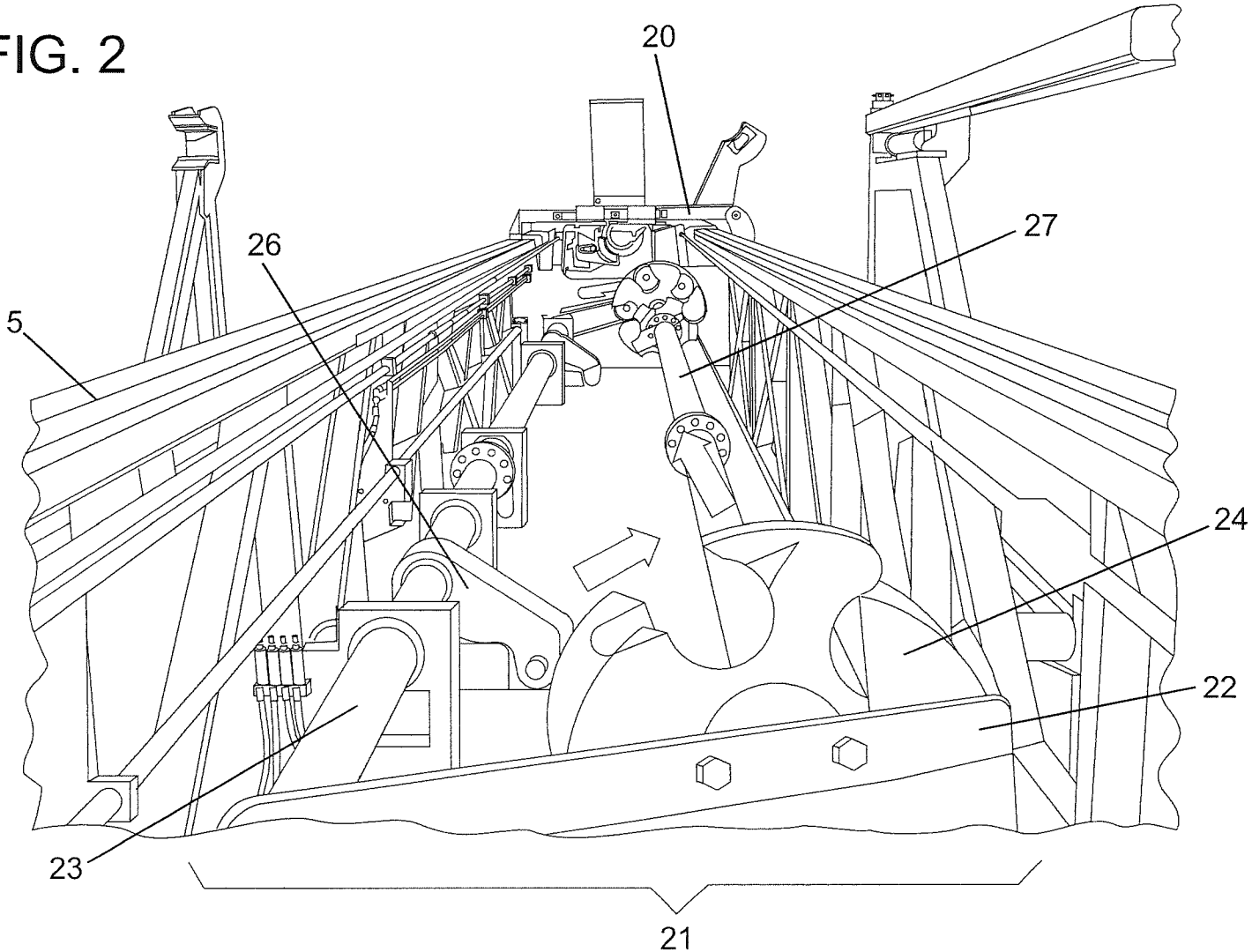
FIGS. 2 and 3 depict further aspects of the blasthole drilling rig of FIG. 1, arranged for transport.
Figure 3:
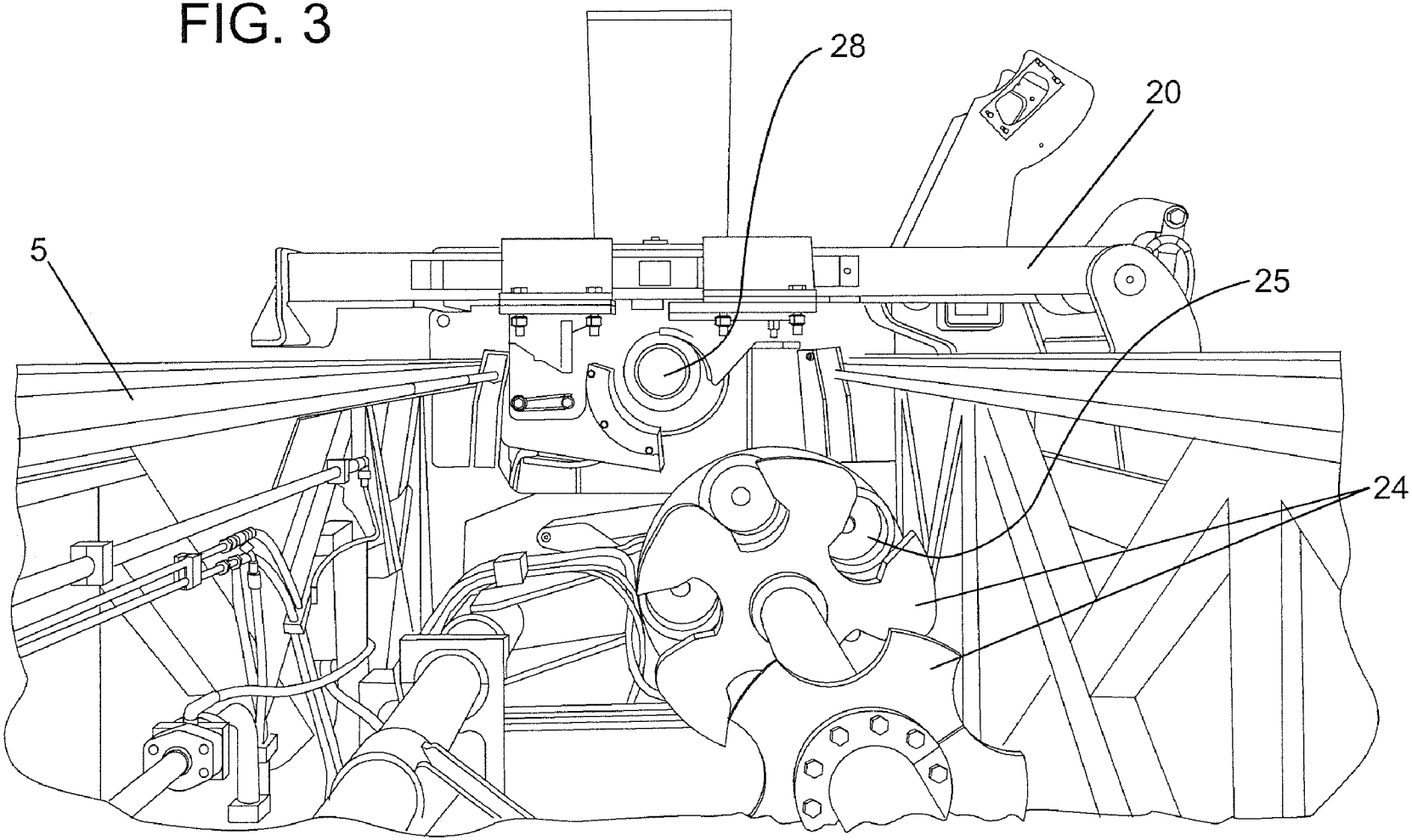
Figure 4A:
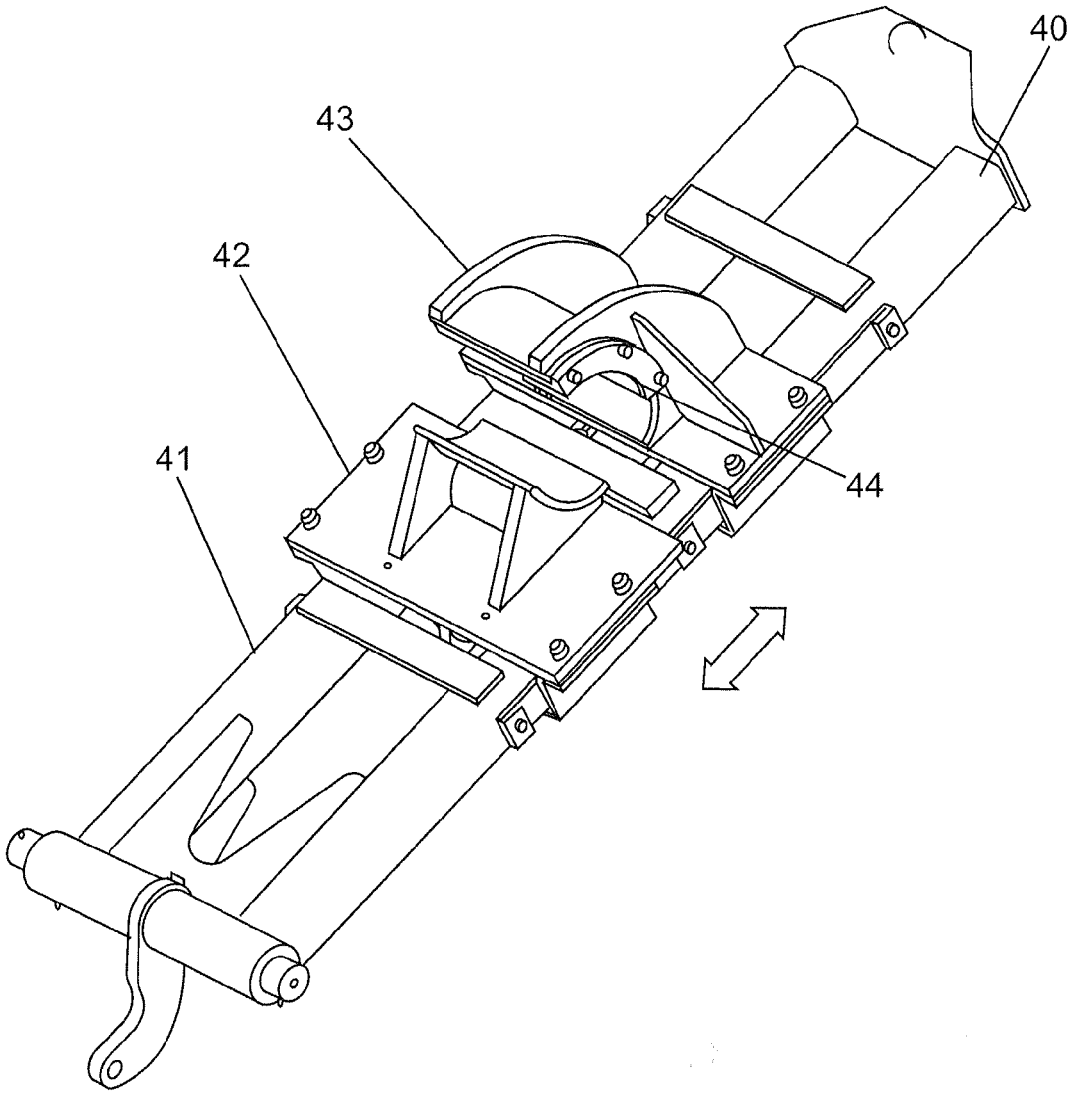
FIG. 4A Prior Art
FIGS. 4A through 4D, collectively referred to herein as FIG. 4, depict aspects of a prior art pipe positioner.
Figure 4B:
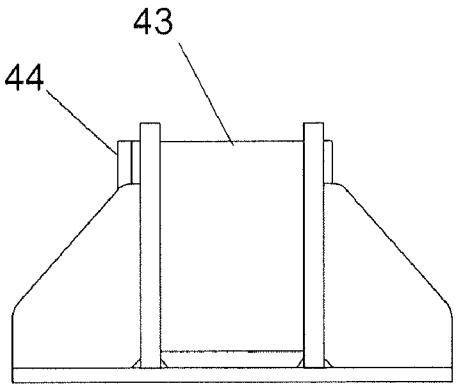
FIG. 4B Prior Art
Figure 4C:
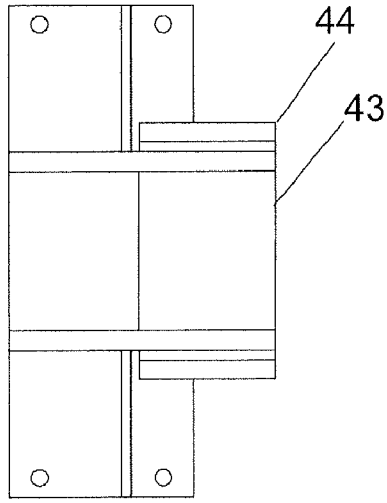
FIG. 4C Prior Art
Figure 4D:
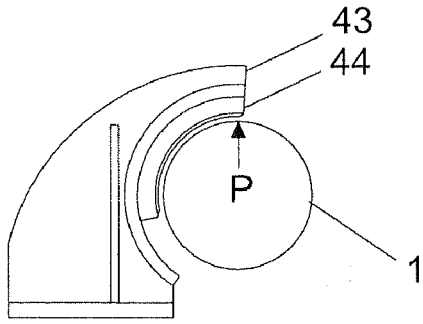
FIG. 4D Prior Art

Referring now to FIG. 1, there is shown an exemplary blasthole drilling rig 10. The blasthole drilling rig 10 is shown with a mast 5 in an upright position, such as would be used for drilling into the earth. FIGS. 2 and 3 provide greater detail on components of the mast 5.

Referring now to FIGS. 2 and 3, the mast includes a carousel 27 disposed therein. In this embodiment, the carousel 27 is generally mounted on at least one swing arm 22. The swing arm 22 is, in turn, mounted to a drive shaft 23. The drive shaft 23 generally rotates partially about a rotational axis by extension of at least one drive arm 26. In this embodiment, each drive arm 26 is extended by use a hydraulically operated piston.

The carousel 27 includes at least one guide 24 and a turntable 25. Together, the at least one guide 24 and the turntable 25 maintain a plurality of lengths of drill pipe. Rotation of the drive shaft 23 results in placing the carousel 27 in a position such that a stationary pipe positioner 20 can clamp down on a length of the pipe. Once the pipe is held by the pipe positioner 20 over a drill guide 28, the carousel 27 is generally returned to a standby position (the standby position being shown in FIGS. 2 and 3). Motion of the drive arm 26 and the carousel 27 is generally depicted by the arrows shown in FIG. 2.

Referring now to FIG. 4, a prior art pipe positioner 40 is shown. In this example, the prior art pipe positioner 40 includes an arm 41, a lower jaw 42 and an upper jaw 43. The upper jaw 43 includes a wear bushing 44 disposed therein for protecting the pipe 1. Note that FIG. 4A provides a perspective view, while FIGS. 4B, 4C and 4D provide side, top and side views respectively. As shown by the bi-directional arrow, at least one of the upper jaw 43 and the lower jaw 42 may be slid along the arm 41. In this manner, the jaws 42, 43 may work together to orient about a length of pipe 1, and to then clamp down upon the pipe 1 (or to release the pipe 1).

Referring now to FIG. 5, there is shown an embodiment of the pipe positioner 20 according to the teachings herein. In this example, the pipe positioner 20 includes an arm 51, a lower jaw 52 and a hinged upper jaw 54 which is mounted to a jaw base 53. The upper jaw 54 is mounted to the jaw base 53 by a pivot pin 55 and at least one shear pin 56. In this embodiment, the upper jaw 54 also includes a wear bushing 57.

Figure 5A:
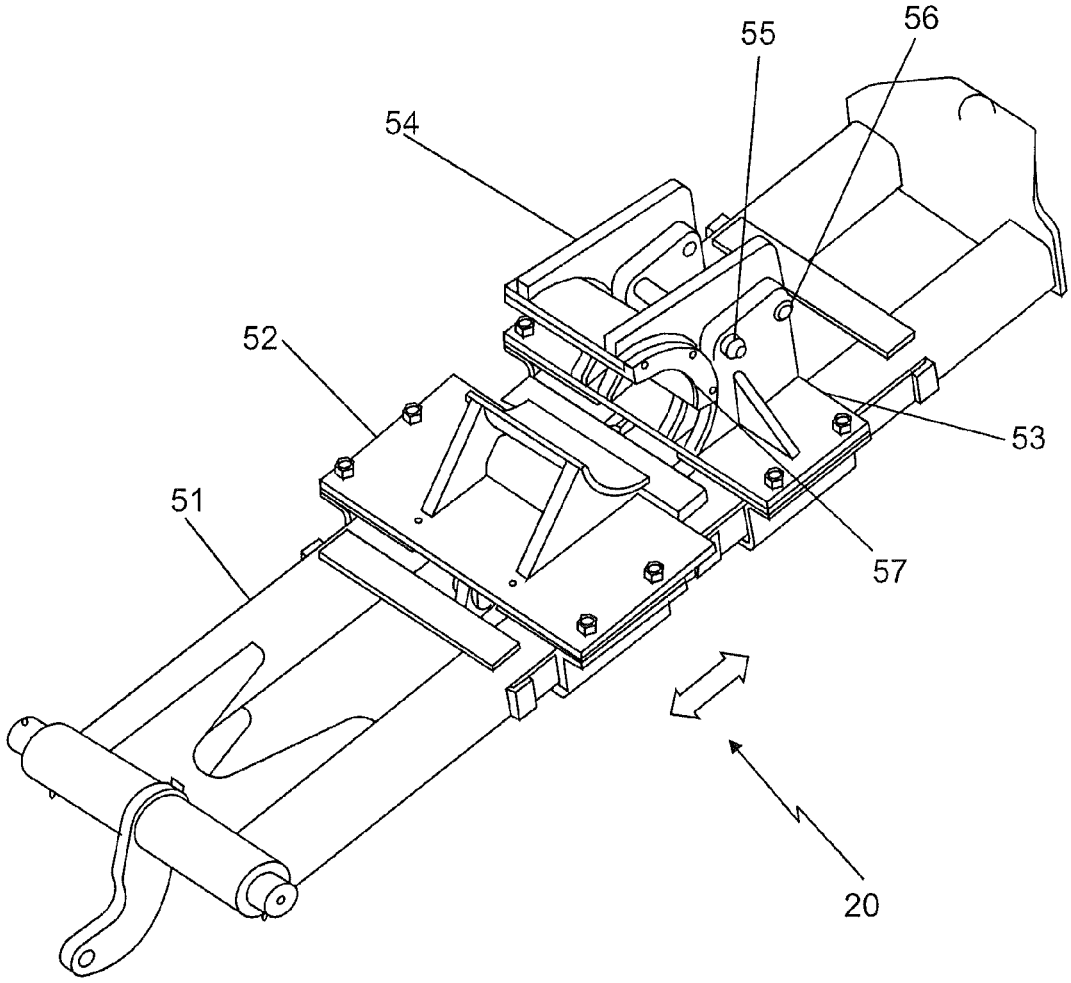
FIGS. 5A through 5D, collectively referred to herein as FIG. 5, depict aspects of a pipe positioner according to the teachings herein.
Figure 5B:
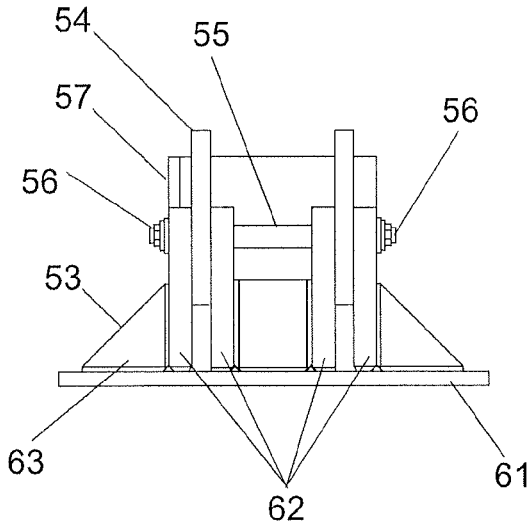
Figure 5C:
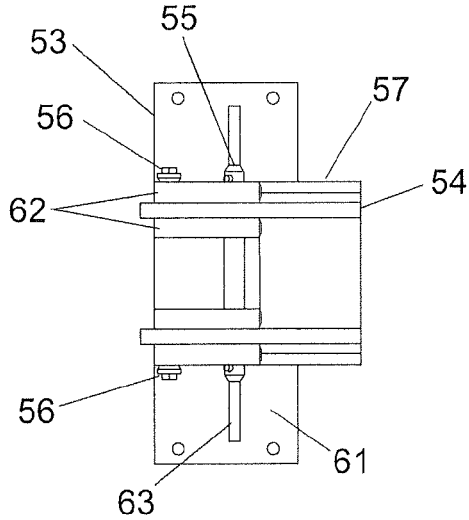
Figure 5D:
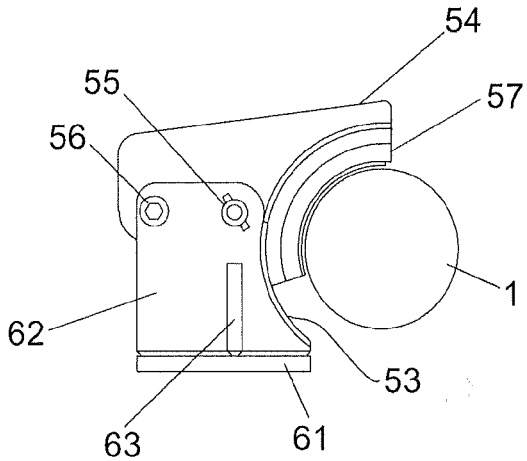

Note that FIG. 5A provides a perspective view, while FIGS. 5B, 5C and 5D provide side, top and side views respectively. As shown by the bi-directional arrow, at least one of the hinged upper jaw 54 and the lower jaw 52 may be slid along the arm 51. In this manner, the jaws 52, 54 may work together to orient about a length of pipe 1, and to then clamp down upon the pipe 1 (or to release the pipe 1).

In the embodiment shown in FIGS. 5B-5D, the jaw base 53 includes a piece of flat stock 61 for coupling to the arm 51. Disposed orthoganally to the flat stock 61 are at least two supporting walls 62. Further, orthogonal to the supporting walls 62 and the flat stock 61, at least one brace 63 may be included. Generally, each of the supporting walls 62 include a through-way for the pivot pin 55 and another through-way for the shear pin 56.

The pipe positioner 20 functions as a lower bushing to center and guide a drill string made of sections of drill pipe 1 during normal drilling operations. The pipe positioner 20 also provides a firm support for the drill pipe 1 during transportation of the drilling rig 10, when the mast is horizontal, vertical, or at an intermediate position (as shown in FIG. 1). During drilling, the two opposed jaws 52, 54 open and close upon hydraulic power, as commanded by the operator and the control system logic. When the jaws are open, the pipe 1 is free to be moved into or out of the drilling position, such as when adding or removing a section of pipe 1 from the drill string. When closed, the two opposed jaws 52, 54 form a bushing which allows axial and rotational freedom of the drill pipe 1, while restraining it to a defined center position, by preventing radial motion. Wear pads of hardened material are attached to the jaws to serve as the points of physical contact with the pipe.

Figure 6A:
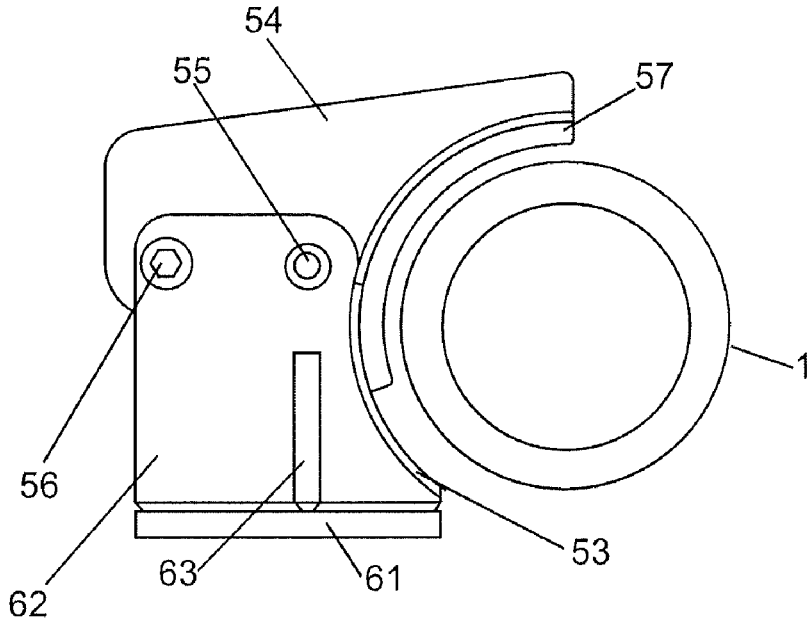
FIGS. 6A and 6B, collectively referred to herein as FIG. 6, depict a hinged upper jaw of the pipe positioner of FIG. 5 in relation to a pipe.
Figure 6B:
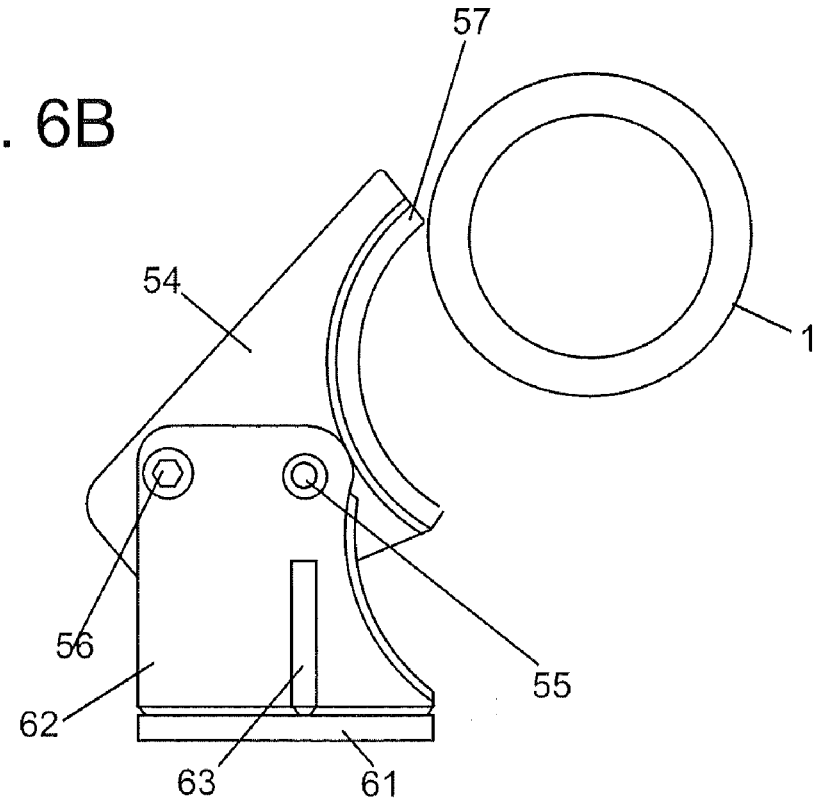

In FIGS. 6 and 7, the hinged upper jaw 54 is shown in a closed position (operational) and an open position (failed). In FIG. 6A and FIG. 6B, the hinged upper jaw 54 is shown with relation to the jaw base 53. In FIG. 6A, the hinged upper jaw 54 is shown retaining the drill pipe 1, while in FIG. 6B, the pipe 1 has been ejected from the pipe positioner 20. That is, in this example and as shown in FIG. 6B, the shear pin 55 has sheared as a result of imposed stress. Accordingly, the pipe positioner 20 has operated successfully in providing protection to other components of the blasthole drilling rig 10.

Figure 7A:
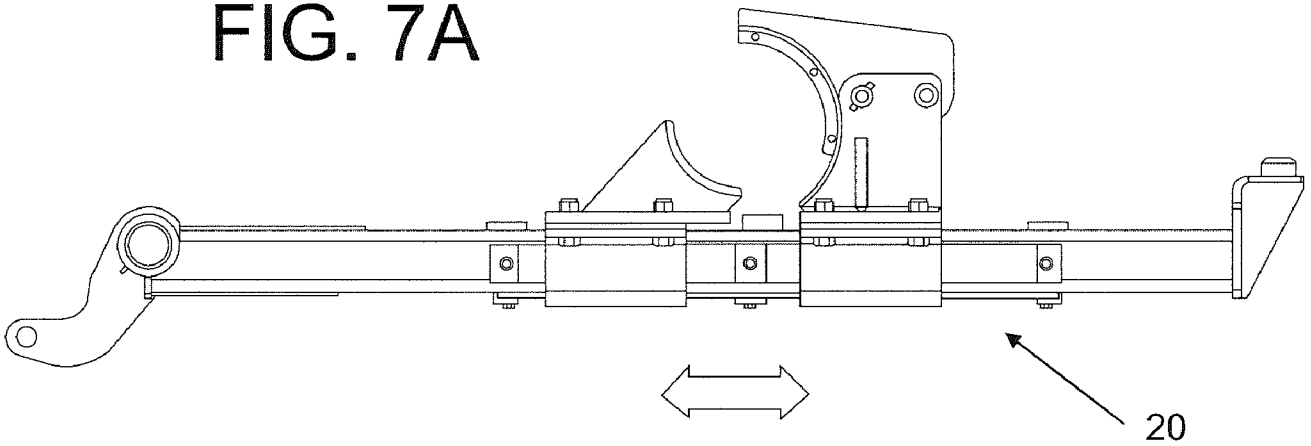
FIGS. 7A and 7B, collectively referred to herein as FIG. 7, depict the pipe positioner of the teachings herein in a closed and an open position, respectively.
Figure 7B:
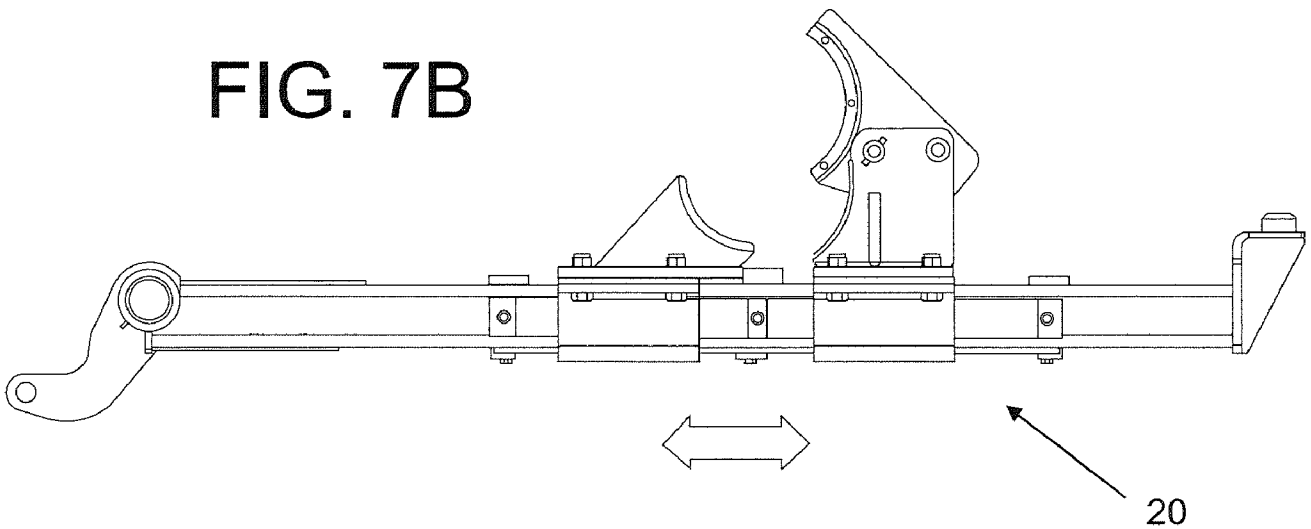

In FIG. 7A and FIG. 7B, the hinged upper jaw 54 is shown with relation to the pipe positioner 20 as a whole. At least one of the lower jaw 52 and the hinged upper jaw 54 may translate along at least a portion of the length of the pipe positioner 20, as noted in FIG. 7 by the directional arrows. FIGS. 7A and 7B depict the operational and failed states shown in FIGS. 6A and 6B (respectively, and from a reverse position). This illustration depicts the upper jaw 54 in relation to other components that are a part of the pipe positioner 20.

Figure 8:
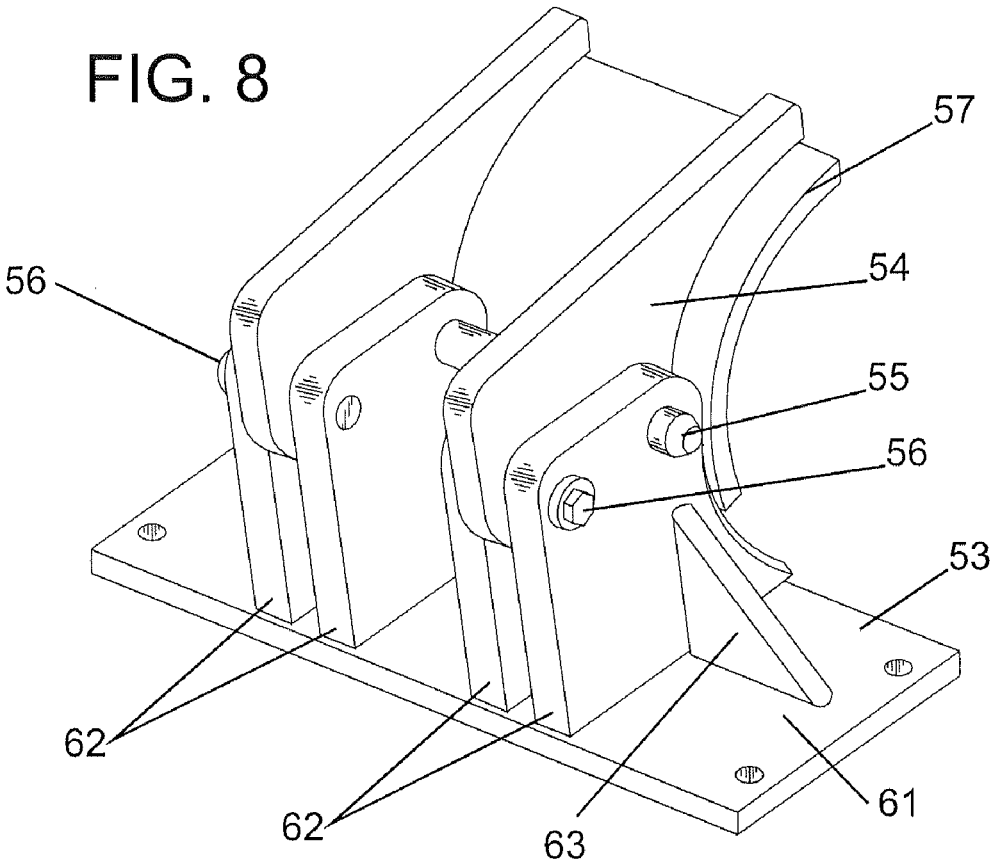
FIG. 8 is another illustration of the hinged upper jaw.

Turning to FIG. 8, a perspective view of the hinged upper jaw 54 is provided. In this illustration, the hinged upper jaw 54 is mounted into the jaw base 53. In this embodiment, two separate shear pins 56 are loaded into through-ways provided in dual support walls 62 and through the hinged upper jaw 54.

Figure 9:
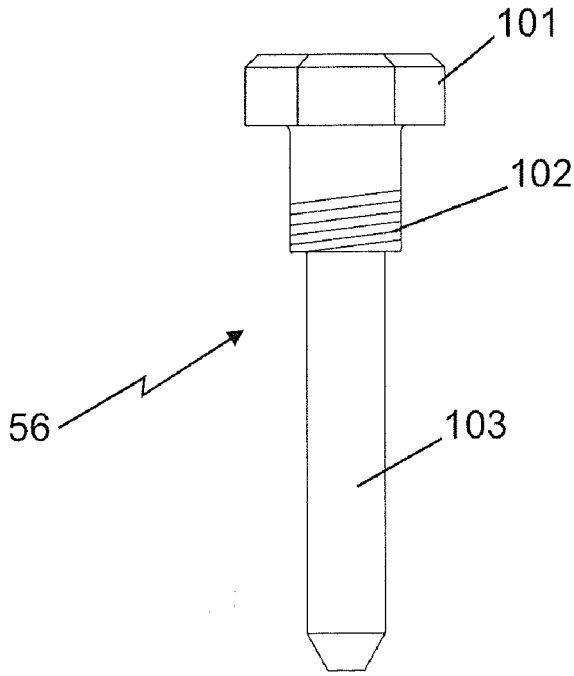
FIG. 9 depicts an embodiment of a shear pin for use with the hinged upper jaw; and, FIG. 10 provides a cross sectional view of an installation of the shear pin.

FIG. 9 depicts an exemplary embodiment of the shear pin 56. In this example, the shear pin 56 includes a bolt head 101, such as a hex head. Below the bolt head 101 is a threaded section 102, and then a shaft 103. Generally, the bolt head 101 provides for securing the threaded section 102 into complimentary threading within a respective through-way provided in the jaw base 53. The shaft section is generally sized to fit securely into the remaining portion of the through-way (or through-ways).

In other embodiments, the shear pin 56 may be pinned into place using at least one cotter pin (such as one at each end). Alternatively, the shear pin 56 may include some form of a head to prevent slipping through the through-way, with a single cotter pin (and washer, if desired) at an opposing end. One shear pin 56 may be used. For example, a single shear pin 56 may be used in one of the support walls 62, or span the space between the support walls 62 (in the case that there are at least two support walls 62) and pass through each support wall 62.

The shear pin 56 may have a cross section that is of any shape desired. For example, the shear pin 56 may be circular, oval, two-sided, three-sided, up to n-sided, where n represents a number selected by a designer. The point at which the shear pin fails under load may be determined by the cross-sectional area at the shear plane and the properties of the material used therein.

The principles of the teachings herein may be applied to any chosen configuration of a fixed member that is loaded in a transverse plane in shear by the relative motion of two or more parts, secured in position to prevent axial movement and free of pre-existing stresses. Geometrical considerations will determine the configuration needed to suit the particular application.

In some other embodiments, the shear pin 56 is designed to be hammered into place and to remain in place by having a tight fit. If a "friction fit shear pin" (a shear pin of these embodiments) fails, then the remaining portions may be tapped out with a chisel, or simply by the alignment of components and insertion of a replacement shear pin 56, which thus drives out the remnants of the sheared pin.

Figure 10:
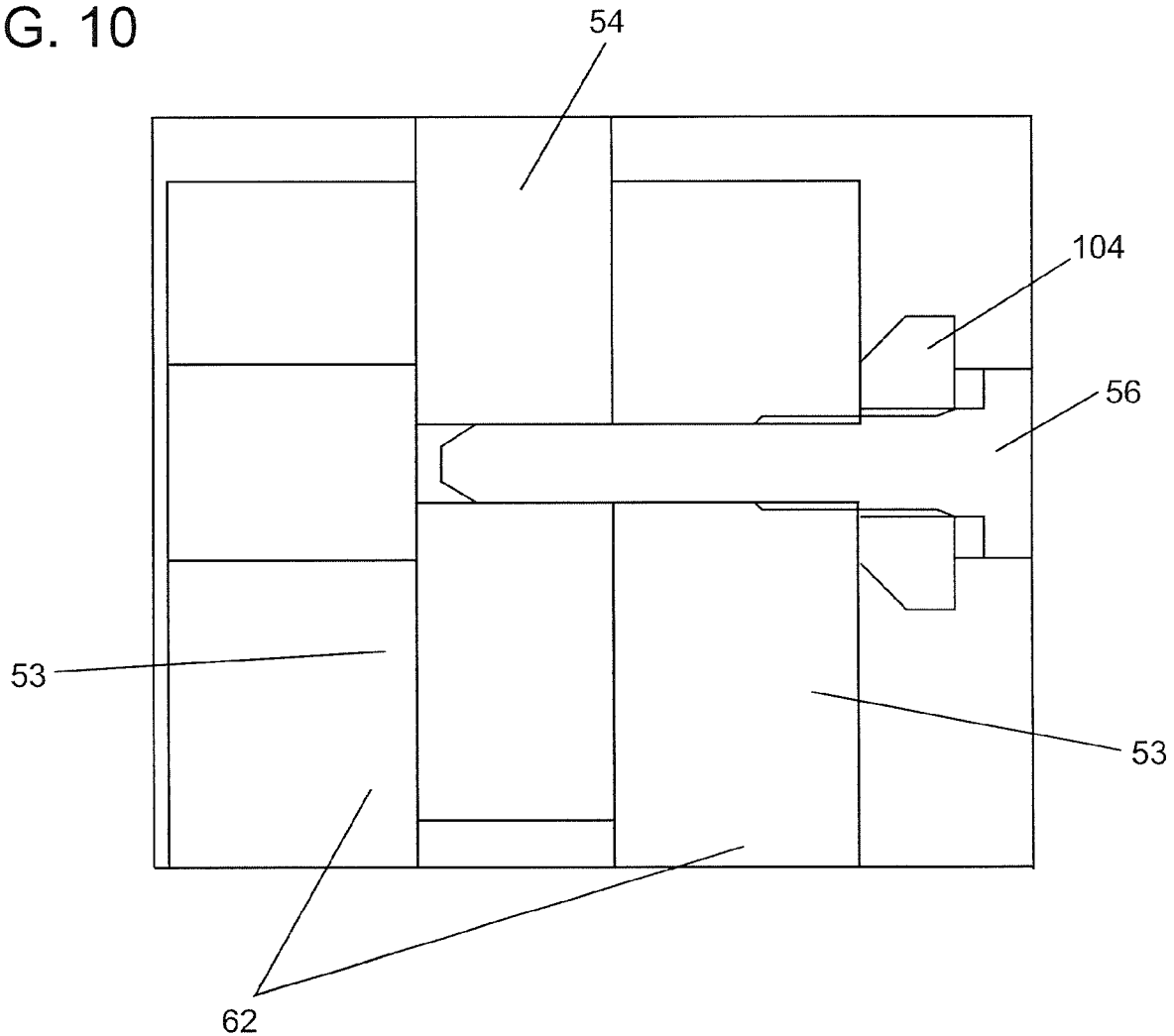

The shear pin 56 may be formed of any material estimated to perform according to design conditions. For example, various alloys may be used. Other "pure" forms of metals may be used. In some embodiments, composite materials or plastics may be selected. In general, the shear pin 56 is formed of a metal that is somewhat softer than metal in the jaw base 53 and the hinged upper jaw 54. Examples include brass, bronze or copper. Combinations of materials may be used. For example, the shear pin 56 may include a metallic core, with a polymeric coating (such as would facilitate installation and retention of the shear pin 56). Other forms of coatings, including coatings with lubricants, may be used. In short, the shear pin 56 may be formed of a metallic composition, a non-metallic composition and any suitable combinations thereof FIG. 10 provides a cross sectional view of an exemplary installation of the shear pin 56. In this example, the shear pin 56 is mounted into a collar 104. The collar 104 is secured to an outer surface of the support wall 62, and provides mounting features (such as a threaded receptacle) for receipt and retention of the shear pin 56.

One skilled in the art will recognize that the foregoing represents certain embodiments of an improved pipe positioner, and that other embodiments may be realized. For example, in other embodiments, the lower jaw 52 may include at least one shear pin 56, while the upper jaw remains fixed (similar to prior art embodiments of the upper jaw). As an example, the lower jaw may include a base and a clamping section, where failure of the at least one shear pin installed in the lower jaw causes the clamping section to collapse into the base.

In some further embodiments, both the lower jaw and the upper jaw include protection in the form of at least one shear pin 56. In such embodiments, the lower jaw and the upper jaw may include shear pins having different shear ratings. In these embodiments, and by way of example only, the lower jaw will collapse first. The pipe is then relatively contained, and will not float freely, while damage is protected against. However, should the pipe remain excessively constrained, such as by undue force, the upper jaw will then open allowing the pipe to move unrestricted.

Accordingly, the pipe positioner 20 may be provided with various forms of overload protection afforded by the incorporation of at least one shear pin.

Having thus described aspects of the improved pipe positioner 20, certain additional features and advantages are now discussed.

This invention provides a fail-safe mechanism which permits the pipe positioner 20 to dissipate abnormal loads, limiting damage to an easily replaced and inexpensive component. The abnormal load will cause at least one shear pin to fail and thereby preventing the transfer of damaging overloads to the drill rig structure and/or the articulating arm 51.

In the event of such overloads on traditional pipe positioners, the pipe is forced against the two jaws, forcing them apart against opposing hydraulic force used to keep the jaws in a closed position. This action wedges the pipe against the curved wear pads, transferring damaging loads to the pipe positioner structure, its articulated arm, and the supporting mast structure. Problems encountered in the prior art are overcome with the introduction herein of a two-piece movable jaw configuration, with the movable portion pinned into a fixed condition by the use of at least one shear pin and at least one hinge pin. In the event of an excessive load, the jaw transfers the load to the shear pins, which fail at a pre-determined condition, allowing the flexible jaw segment to open, permitting the drill pipe to be moved out of its center position. As a result, the excessive load is not transferred to other components of the pipe positioner or the mast.

In some embodiments, a breaking point of the shear pins is calculated to resist loads exceeding the normal maximum loading. The magnitude of the transmitted load to the at least one shear pin may be determined by evaluating a combination of jaw geometry, a location of a pivot pin, a vectored resolution of applied forces, and a location of the at least one shear pin. The failure point of the shear pin is determined by the cross-sectional area of the pin and the material properties, mainly the shear yield point, from which it is made.

Advantages realized include introduction of components that are physically interchangeable with existing, traditional designs. The components do not require any additional control or actuation components, and serve as mechanical fuses to prevent damaging loads from being applied to the rest of the drill rig. By preventing damage from occurring, the occasional overload conditions that occur are addressed through subsequent failure of the shear pins. Accordingly, users are provided with apparatus that may be easily and quickly maintained in the field by replacing the at least one shear pin. In contrast, with traditional pipe positioner designs, the resulting damage from an overload condition often causes an extended interruption to drilling operations and large repair costs, often requiring the drill rig to be returned to a repair shop.

In some embodiments, the shear pin design uses a threaded portion that screws into the fixed structure of the jaw, with an unthreaded extension of close tolerance diameter which passes from one tight-fitting bore in the support structure into a similar tight-fitting hole in the moveable jaw component. In this manner, the shear pin may be subject to side load caused by the differential movement of the moveable jaw portion relative to the support structure. The side load bears on the pin in at least a single shear plane, providing a predictable point of failure when the force on the moveable jaw exceeds the pin's material strength. Replacement of a broken pin requires the removal of the threaded section with the use of a common hand wrench, and removal of the broken-off section of pin that remains in the large clearance hole in the support structure. A new pin may be tightened into the support structure against a cut lockwasher or similar anti-loosening device to prevent loosening in service; the threads at the head end of the pin assure that no stress is applied to the shear section of the pin during tightening, thus assuring a predictable failure point.

The invention provided herein offers distinct advantages over other techniques for overload protection. That is, several other methods of allowing a moveable portion of the jaws to open under excessive load were explored. It was determined to be unfeasible to provide a logic command to prevent the incorrect sequencing, as this falls upon the operator and training to maintain proper sequencing. It was also determined that the use of a spring, either mechanical or hydraulic-pneumatic, was not practical in the space provided, nor would the design be readily interchangeable with the new design. From a point of view of simplicity, robustness, retrofitability, and quickness of correction in the field, this invention provides users with an excellent solution.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A blasthole drilling rig, comprising:

a mast having a carousel therein, the carousel for providing at least one length of drill pipe to a drilling apparatus;

a pipe positioner for clamping the at least one length of drill pipe;

wherein the pipe positioner comprises an arm coupled to the mast and comprising a lower jaw and an upper jaw mounted thereon, at least one of the lower jaw and the upper jaw comprising at least one shear pin disposed in location to provide protection of the pipe positioner from mechanical overload.

2. The blasthole drilling rig as in claim 1, wherein the lower jaw comprises a collapsible lower jaw that is predisposed to an operational position and configured to collapse at a predetermined load to provide protection of the pipe positioner from mechanical overload.

3. The blasthole drilling rig as in claim 1, wherein the upper jaw comprises a hinged upper jaw that is predisposed to an operational position and configured to open at a pre-determined load to provide protection of the pipe positioner from mechanical overload.

4. The blasthole drilling rig as in claim 1, wherein the pipe positioner is adapted for securing at least one of a length of drill pipe and the carousel during transport of the rig.

5. The blasthole drilling rig as in claim 1, further comprising a hydraulic system for powering manipulations of the pipe positioner.

6. The blasthole drilling rig as in claim 1, further comprising a control system for remote control by an operator.

7. The blasthole drilling rig as in claim 1, wherein at least one of the lower jaw and the upper jaw translate along a least a portion of a length of the arm.

8. The blasthole drilling rig as in claim 1, wherein a bolt head of the at least one shear pin comprises an n-sided bolt head.

9. The blasthole drilling rig as in claim 1, wherein the at least one shear pin comprises at least one of a bolt head, a threaded section and a shaft.

10. The blasthole drilling rig as in claim 1, wherein the at least one shear pin is adapted for being secured by a mechanical means.

11. The blasthole drilling rig as in claim 1, wherein the at least one shear pin is a friction fit shear pin.

12. The blasthole drilling rig as in claim 1, wherein the at least one shear pin comprises a coating disposed thereon.

13. The blasthole drilling rig as in claim 1, wherein the at least one shear pin comprises a combination of a metallic composition and a non-metallic composition.

14. The blasthole drilling rig as in claim 1, wherein the at least one shear pin comprises one of a metallic composition and a non-metallic composition.

15. The blasthole drilling rig as in claim 1, wherein the lower jaw comprises a collapsible lower jaw.

* * * * *